US011064782B2

(12) United States Patent
Debauge et al.

(10) Patent No.: US 11,064,782 B2
(45) Date of Patent: Jul. 20, 2021

(54) APPLICATION SYSTEM FOR APPLYING A PRODUCT TO HAIR

(71) Applicant: L'OREAL, Paris (FR)

(72) Inventors: Anne Debauge, Clichy (FR); Aline Overtheil, Clichy (FR)

(73) Assignee: L'OREAL, Paris (FR)

( * ) Notice: Subject to any disclaimer, the term of this patent is extended or adjusted under 35 U.S.C. 154(b) by 384 days.

(21) Appl. No.: 15/514,807

(22) PCT Filed: Nov. 20, 2014

(86) PCT No.: PCT/IB2014/066203
§ 371 (c)(1),
(2) Date: Mar. 27, 2017

(87) PCT Pub. No.: WO2016/046610
PCT Pub. Date: Mar. 31, 2016

(65) Prior Publication Data

US 2017/0215546 A1 Aug. 3, 2017

(30) Foreign Application Priority Data

Sep. 25, 2014 (FR) ..... 14 59079

(51) Int. Cl.
*A45D 19/00* (2006.01)
*A45D 19/02* (2006.01)
(Continued)

(52) U.S. Cl.
CPC ..... *A45D 19/02* (2013.01); *A45D 19/012* (2021.01); *A45D 24/04* (2013.01); *A46B 1/00* (2013.01);
(Continued)

(58) Field of Classification Search
CPC .... A45D 14/22; A45D 19/0008; A45D 19/02; A45D 2019/0066; A45D 24/04;
(Continued)

(56) References Cited

U.S. PATENT DOCUMENTS 26,215 A * 11/1859 Keefe ..... D06F 15/00 68/120
2,190,277 A * 2/1940 Viragh ..... A46B 9/026 138/38
(Continued)

FOREIGN PATENT DOCUMENTS

CN 203483015 U 3/2014
CN 103704976 A 4/2014
(Continued)

OTHER PUBLICATIONS

May 28, 2015 International Search Report issued in International Patent Application No. PCT/IB2014/066203.

*Primary Examiner* — Yogesh P Patel
*Assistant Examiner* — Jennifer Gill
(74) *Attorney, Agent, or Firm* — Oliff PLC

(57) ABSTRACT

An applicator for applying a product to hair, especially a hair colouring product, including: at least one first row of teeth extending longitudinally over a distance $l_1$, from a first application face of the applicator; and a plurality of second rows of teeth, extending longitudinally over a distance $l_1$, from a second application face of the applicator, which is arranged opposite the first application face, the ratio $l_1/l_2$ being lower than or equal to 0.75.

14 Claims, 5 Drawing Sheets

(51) Int. Cl.

| | |
|---|---|
| ***A46B 1/00*** | (2006.01) |
| ***A46B 5/00*** | (2006.01) |
| ***A46B 9/02*** | (2006.01) |
| ***A45D 24/04*** | (2006.01) |

(52) U.S. Cl.
CPC ..... *A46B 5/0008* (2013.01); *A46B 9/023* (2013.01); *A46B 9/028* (2013.01); *A45D 19/0066* (2021.01); *A46B 2200/104* (2013.01)

(58) Field of Classification Search
CPC .... A45D 24/22; A45D 40/265; A45D 40/267; A45D 40/268; A45D 40/262; A45D 2019/025; A45D 24/16; A45D 19/012; A46B 1/00; A46B 15/0059; A46B 2200/104; A46B 2200/1046; A46B 2200/1053; A46B 2200/106; A46B 2200/3033; A46B 5/0008; A46B 9/02; A46B 9/021; A46B 9/023; A46B 9/026; A46B 9/028; A46B 9/045
USPC ..... 132/112, 120, 139, 218, 219, 122; 15/105, 106; D28/25, 29, 28; D4/117
See application file for complete search history.

(56) References Cited

U.S. PATENT DOCUMENTS

| | | | | | |
|---|---|---|---|---|---|
| 2,250,112 | A * | 7/1941 | Larson | A46B 9/023 | 15/160 |
| 2,633,591 | A * | 4/1953 | Servilla | A45D 24/18 | 132/120 |
| D207,050 | S * | 2/1967 | Vallis | D4/117 | |
| D211,677 | S * | 7/1968 | Bulow | D28/29 | |
| 3,409,029 | A * | 11/1968 | Kumpa | A45D 24/04 | 132/133 |
| D213,669 | S * | 4/1969 | Miller | D4/106 | |
| 4,592,376 | A * | 6/1986 | Sigmund | A45D 19/02 | 132/112 |
| 5,065,470 | A * | 11/1991 | Diamond | A46B 9/04 | 15/106 |
| 5,449,006 | A * | 9/1995 | Hogan | A45D 24/10 | 132/112 |
| 6,189,540 | B1 * | 2/2001 | Stovall | A45D 24/04 | 132/139 |
| 7,581,898 | B2 * | 9/2009 | Gueret | A45D 40/265 | 132/218 |
| 7,650,893 | B2 * | 1/2010 | De Laforcade | A46B 9/021 | 132/218 |
| 2008/0289130 | A1 * | 11/2008 | Bubbers | A46B 9/02 | 15/160 |
| 2010/0175708 | A1 * | 7/2010 | Kim | A46B 9/021 | 132/218 |
| 2011/0041863 | A1 | 2/2011 | Roualdes | | |
| 2015/0250293 | A1 * | 9/2015 | Hauger | A45D 40/26 | 401/129 |

FOREIGN PATENT DOCUMENTS

| | | | |
|---|---|---|---|
| FR | 2 876 255 | A1 | 4/2006 |
| FR | 2 949 185 | A1 | 2/2011 |
| JP | H04-93003 | U | 8/1992 |
| JP | 2002-065336 | A | 3/2002 |
| JP | 2002-101943 | A | 4/2002 |
| JP | 2004-154426 | A | 6/2004 |
| JP | 2006-326081 | A | 12/2006 |

* cited by examiner

APPLICATION SYSTEM FOR APPLYING A PRODUCT TO HAIR

The present invention relates to an applicator for applying a product to the hair, notably a hair dyeing product.

BACKGROUND

Numerous devices that comprise a container and an applicator provided with teeth for distributing the product contained in the container over the hair are known. Applying the product is often complicated and requires expert hand movements in order to obtain a uniform result over all of the hair.

Application along the length of the hair, to the temples and to the roots of the hair is generally carried out with two different tools. A brush having bristles makes it possible to apply the product along the length of the hair, and a comb makes it possible to apply the product to the temples and the roots of the hair. This complicates application.

The product is generally applied to the hair with the aid of a cannula fitted on a container and then distributed over the hair with the aid of the applicator. The application of the product makes it necessary to lift the arm above chin height and makes it uncomfortable to apply the product.

Applicators for applying a dyeing product to the hair, comprising a brush that receives the dyeing product before application on one side and a comb on the other side, are known from the patent applications JP 2004-154426, JP 2006-326081, CN 103704976 and CN 203483015.

An applicator that comprises a brush on each side, the brushes being connected by a hinge, is also known from the application JP 2002-65336.

A brush for applying a product to the hair, comprising a plurality of rows of application elements, the peripheral and central application elements not having the same flexibility, is also known from the application FR 2 876255.

SUMMARY

There is a need to improve applicators for applying product to the hair in order to be able to carry out uniform, precise, easy and comfortable application of a haircare product along the length of the hair, to the temples and to the roots with a single applicator.

The invention aims to meet this need and it achieves this aim by virtue of an applicator for applying a product to the hair, notably a dyeing product, comprising:

- at least one first row of teeth extending longitudinally over a distance $l_1$ from a first application face of the applicator,
- a plurality of second rows of teeth, this plurality extending longitudinally over a distance $l_2$ from a second application face of the applicator that is situated on the opposite side from the first application face, the ratio $l_1/l_2$ being less than or equal to 0.75.

The second application face makes it possible to apply the product uniformly along the length of the hair, and the first application face makes it possible to apply the product to the temples and the roots of the hair.

The fact that several second rows of teeth extend from the second face makes it possible to define, between the teeth, spaces that can receive the cosmetic product before it is applied to the hair. This allows better control over the quantity of product applied.

The fact that the first row is shorter allows more precise application of the product to the hair, at the temples and the roots.

The expression "extending longitudinally over a distance x" should be understood as meaning that the most distant points of the teeth in question are separated by a distance x.

The ratio $l_1/l_2$ may be less than or equal to 0.6.

Preferably, the first and the second application face are flat.

The first and the second application face may or may not have parallel longitudinal axes.

Preferably, the applicator comprises at least two first rows of teeth, preferably at least three first rows of teeth. The fact that there are several first rows of teeth makes it possible to have a greater quantity of product retained on the applicator, the latter notably being applied directly to the applicator between the teeth, for example with the aid of a cannula.

The first rows of teeth may be parallel to one another.

Preferably, the teeth of the first rows of adjacent teeth are not aligned in a direction perpendicular to the longitudinal axis of the first application face.

The distance $D_1$ between the outermost first rows of teeth on the first application face may be between 3 and 15 mm, the distance $D_1$ being the distance, along an axis perpendicular to the longitudinal axis of the first application face, between the most distant points of the teeth of the outermost first rows of teeth on the first application face.

The applicator may comprise at least two first rows of teeth, better still three first rows, the first rows being at different distances from one another.

The teeth of each first row are preferably spaced apart by a distance q of between 0.2 mm and 2 mm. This allows effective retention of the product in the spaces between the teeth, by capillary action, such that said product does not flow off the applicator before application.

Preferably, the teeth of the first row(s) each have a longitudinal axis perpendicular to the first application face. Similarly, the teeth of the second rows preferably each have a longitudinal axis perpendicular to the second application face.

The teeth of the first row(s) are preferably longer than the teeth of the second rows, the ratio $L_2/L_1$ being between 0.5 and 1.5, better still between 0.8 and 1, $L_1$ being the greatest length of the teeth of the first row(s) and $L_2$ being the greatest length of the teeth of the second rows, the length of a tooth being defined between its base and its distal end along its longitudinal axis.

Preferably, the second rows of teeth comprise:

- at least two external rows of teeth,
- at least one internal row of teeth disposed between the two external rows, the teeth of the external rows advantageously being more flexible than the teeth of the internal rows.

The distance $D_2$ between the external rows may be between 5 and 40 mm, the distance $D_2$ being the distance, along an axis perpendicular to the longitudinal axis of the second application face, between the most distant points of the teeth of the external rows.

The shortest distance d between the internal rows and the external row(s) may be between 0.3 mm and 15 mm, better still between 1 mm and 5 mm.

The distance q between two adjacent teeth of an external row is preferably between 0.2 mm and 2 mm. This distance allows good retention of the product between the teeth.

The second rows of teeth preferably comprise at least two internal rows, better still at least three internal rows, even better still at least five internal rows. The internal rows of teeth may be equidistant from one another, the internal rows of adjacent teeth being separated from one another by a distance r of between 0.5 mm and 10 mm, better still between 1 mm and 6 mm.

Preferably, the teeth of the internal rows are disposed in staggered rows with respect to one another. This also allows good retention of the product on the applicator before application, such that it does not escape from the latter before application, and forms spaces between the teeth in which the product can easily be deposited, notably with the aid of a cannula.

The second application face and the second rows of teeth are preferably symmetrical relative to a longitudinal plane of symmetry M.

Preferably, the teeth of the first rows and/or the external teeth have a pyramid shape, notably with a triangular base, the teeth of the outermost first rows having, notably, a ridge that is oriented outward. Such a shape allows a large area of contact between the teeth and the hair and better retention of the product between the teeth. In a variant, the teeth of the first rows and/or the external teeth have a cylindrical shape, notably with a circular, oval or polygonal base.

Preferably, the teeth of the first rows and/or of the external rows are made of thermoplastic material, notably of polyolefin, PP, PE, ABS, TPE, PET or PA.

Preferably, the teeth of the internal row(s) are not all the same height and/or the same width. The first and the last teeth of each internal row may be the widest and tallest teeth of said internal row.

The applicator may comprise a handle that is notably moulded with the rest of the applicator. The handle preferably comprises lateral reinforcements, notably lateral reinforcements with a thickness e of between 0.1 mm and 5 mm. The handle may have, at least in part, a thickness and/or a width that decreases toward the distal end; notably, the handle may be flattened with an axis perpendicular to the longitudinal axis of the teeth.

The applicator may have an overall T shape in cross section, at least along a part of its length, notably in its part bearing the first and second application faces.

A further subject of the invention is a system for applying a product to the hair, notably a dyeing product, comprising an applicator as described above and a reservoir containing the product to be applied, the reservoir preferably comprising a cannula for depositing the product between the teeth of the applicator.

At its end, the cannula may have an outside diameter of between 0.5 mm and 10 mm.

BRIEF DESCRIPTION OF THE DRAWINGS

The invention may be better understood from reading the following detailed description of nonlimiting exemplary embodiments thereof and from examining the appended drawing, in which.

DETAILED DESCRIPTION OF EMBODIMENTS

Figure 1:
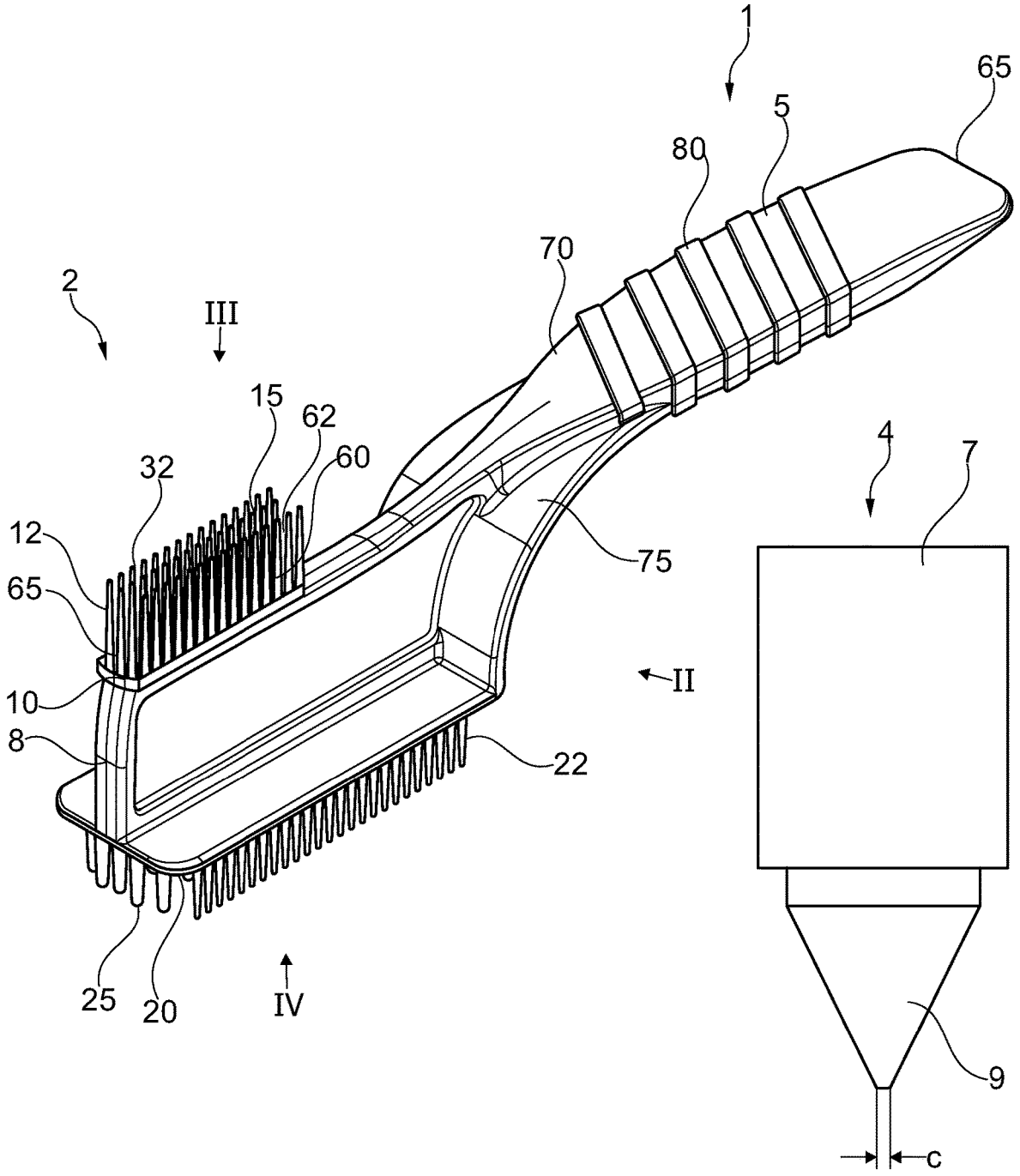
FIG. 1 is a schematic perspective view of an example of a system according to the invention.

FIGS. 1 to 4 show a system 1 comprising an applicator 2 and a container 4.

The container 4 comprises a body containing the product to be applied and a cannula 9 for applying the product to the hair and/or the applicator 2. The outside outlet diameter c of the cannula 9 is advantageously between 0.5 mm and 10 mm.

The applicator 2 may comprise a handle 5 that allows the applicator 2 to be gripped, and a body 8 for applying a product to the hair, notably a dyeing product.

The body 8 has a first application face 10 from which at least one first row 12 of teeth 15 extends, and a second application face 20 from which a plurality of second rows 22 of teeth 25 extend.

The first and the second application faces 10 and 20 are, as illustrated, opposite faces of the body 8 of the applicator 2.

The first and second application faces 10 and 20 can extend along respective longitudinal axes P and Q that are or are not parallel.

Preferably, the first and second application faces 10 and 20 are flat.

The first and the second application face 10 and 20 can be parallel and separated by a distance p that is less than or equal to 50 mm, better still between 10 mm and 30 mm.

The first application face 10 is preferably less wide than the second application face 20.

Figure 7:
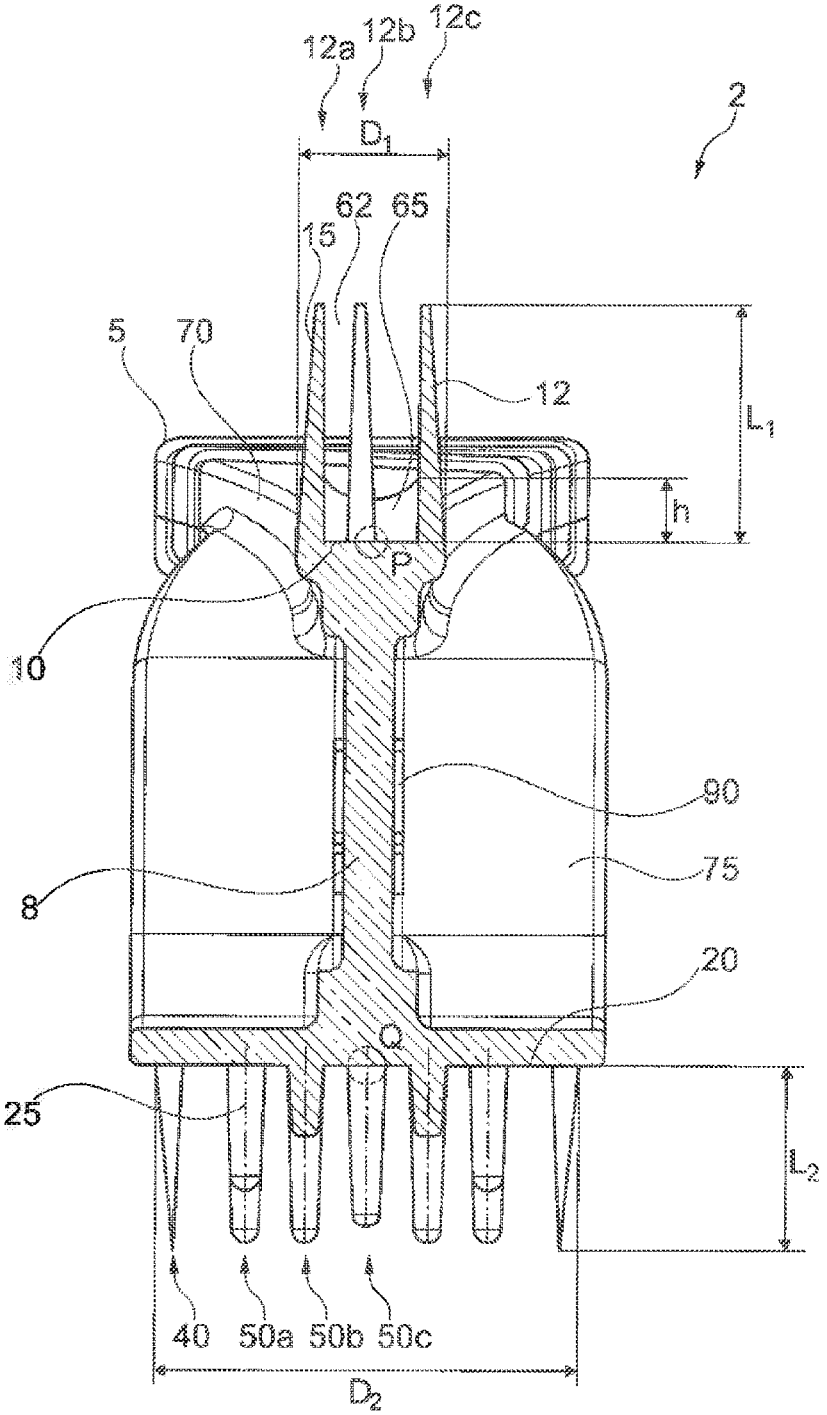
FIG. 7 is a cross-sectional view on VII-VII of the applicator in FIGS. 2 to 4.

Preferably, as illustrated in FIG. 7, the body 8 of the applicator 2 has substantially a T-shaped section, the cross bar of the T defining the second application face 20.

Preferably, the second rows 20 of teeth 25 comprise two external rows 40 of teeth 25 and at least one internal row 50 of teeth 25, the teeth of the external rows 40 being more flexible than the teeth of the internal row(s) 50.

In the examples illustrated, the first application face 10 bears three first rows 12*a* to 12*c* of teeth 15 and the second application face 20 bears seven second rows 22 of teeth 25, including five internal rows 50, but this does not have to be the case.

The first rows 12 extend along a length shorter than that of the second rows 22. The ratio of the lengths $l_1/l_2$ is less than or equal to 0.75, better still less than or equal to 0.6, $l_1$ being the distance between the most distant points of the first and last tooth 15 of the longest first row 12, and $l_2$ being the distance between the most distant points of the first and last tooth 25 of the longest second row 22.

The first and second rows 12 and 22 of teeth can comprise more than 5 teeth each, better still more than 10 teeth each. Preferably, the first rows 12 and the external rows 40 comprise more teeth than the internal rows 50.

The width of the first application face 10 can be substantially equal to the distance $D_1$ between the outermost first rows of teeth 12*a* and 12*c*, this distance $D_1$ being defined between the outermost points, notably, as illustrated, between the outer ridges 30 of the teeth 15. The distance $D_1$ is preferably between 3 and 15 mm.

The width of the second application face 20 can be substantially equal to the distance $D_2$ between the external rows of teeth 40, this distance $D_2$ being defined between the outermost points, notably, as illustrated, between the outer ridges 45 of the teeth 25. The distance $D_2$ is preferably between 5 and 40 mm.

Figure 2:
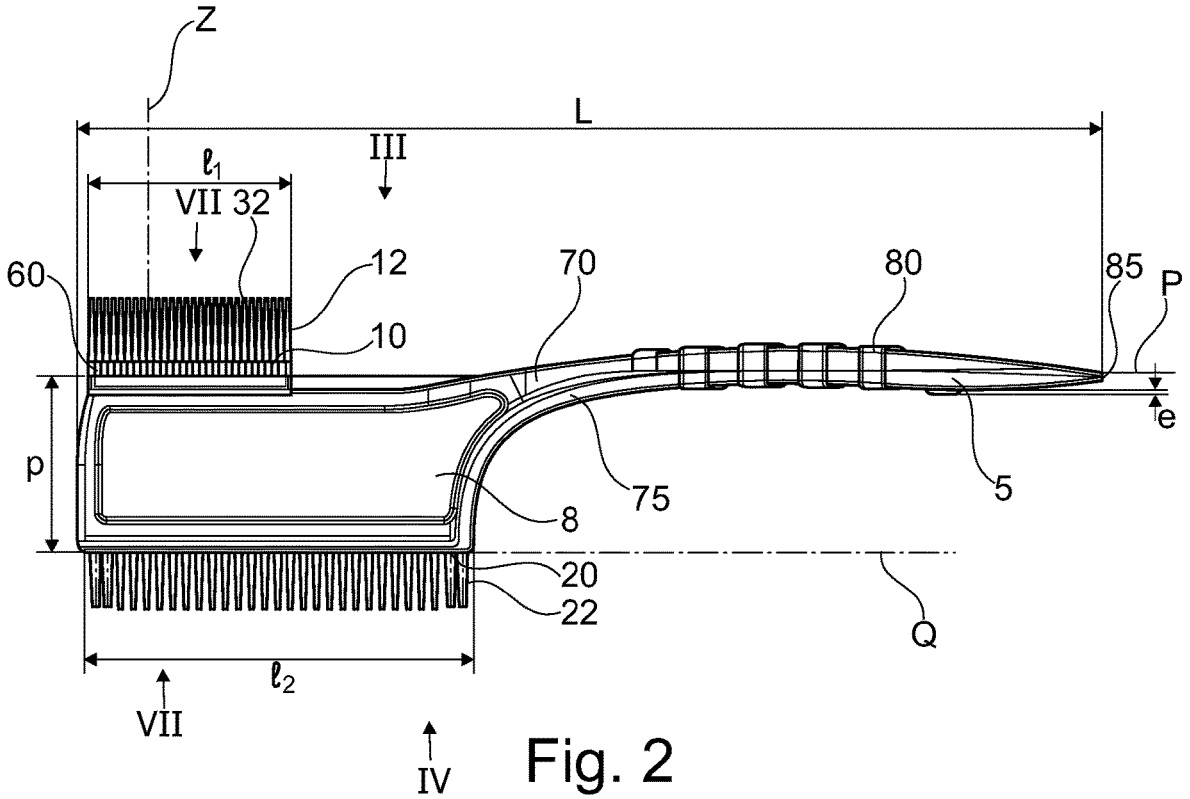
FIG. 2 is a side view along the arrow II of the applicator in FIG. 1.
Figure 3:
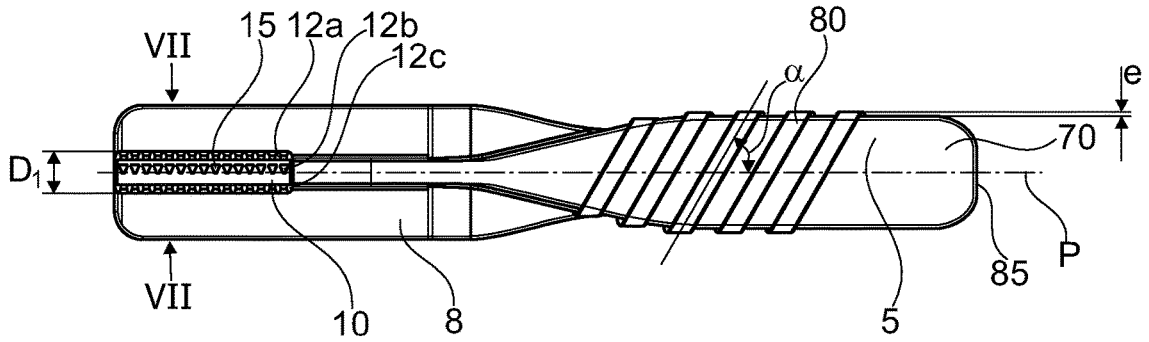
FIG. 3 is a top view along the arrow III of the applicator in FIGS. 1 and 2.
Figure 4:
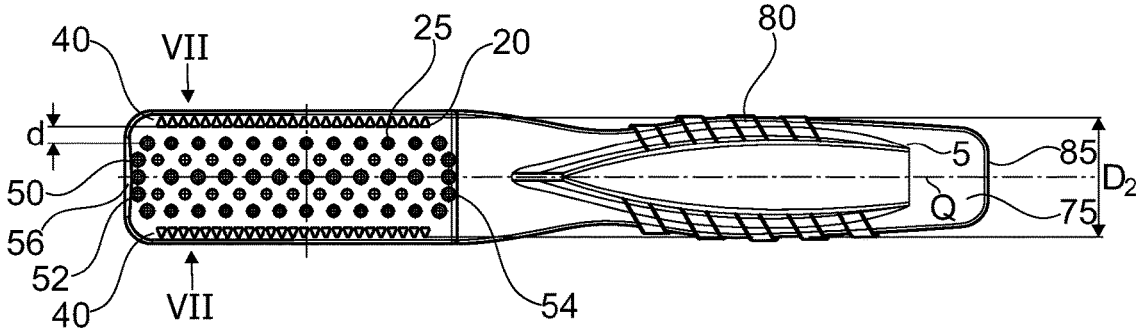
FIG. 4 is a bottom view along the arrow IV of the applicator in FIGS. 1 and 2.
Figure 5:
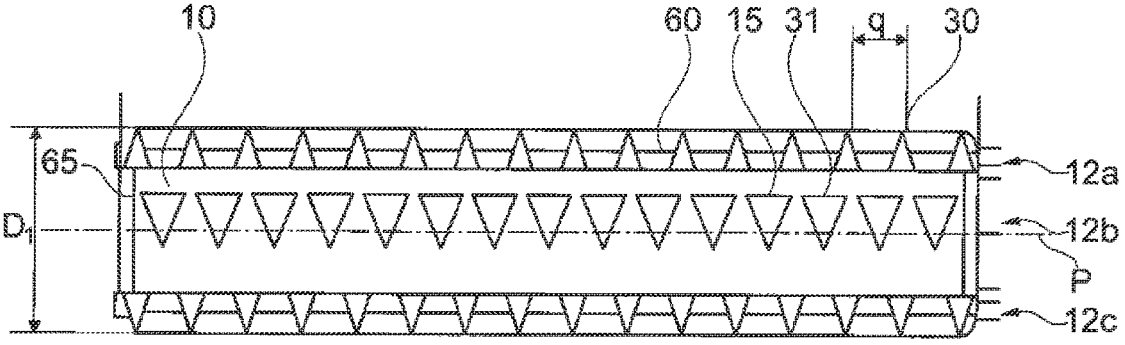
FIG. 5 shows the first application face in FIGS. 1 to 4.
Figure 6:
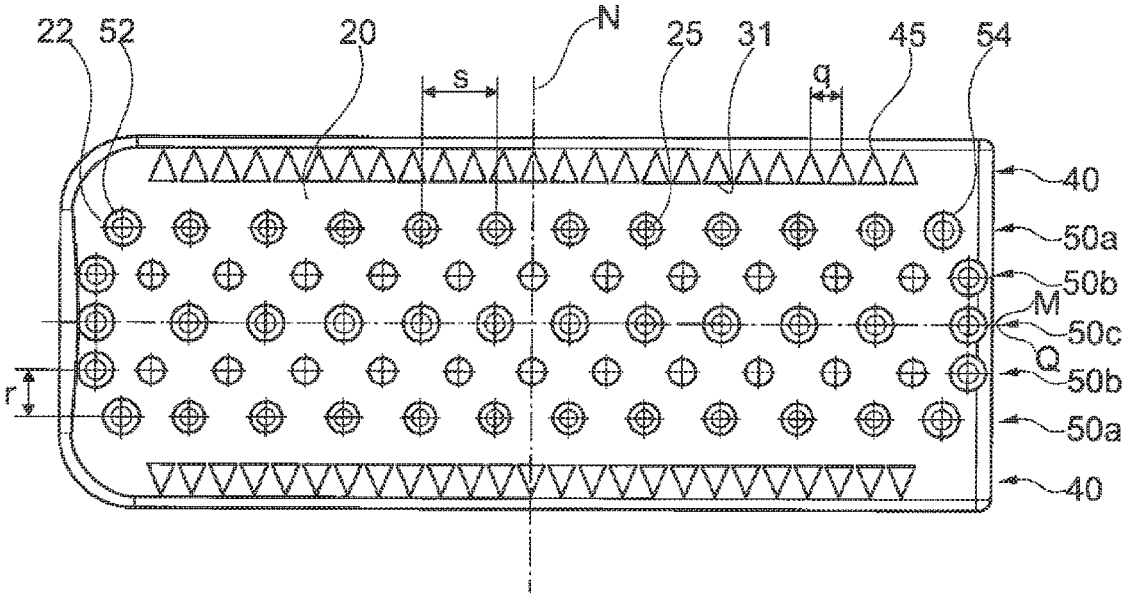
FIG. 6 shows the second application face in FIGS. 1 to 4.

The teeth 15 of the first rows of teeth 12 and the teeth 25 of the external rows 40 preferably have a pyramid shape with a triangular base, as illustrated in FIGS. 5 and 6, and narrow toward their free end 32, as can be seen in FIGS. 1 and 2. The teeth 15 of the first rows of teeth 12 and the teeth 25 of the external rows 40 have a base 31, that is to say a cross section at their junction with the corresponding application face 10 or 20, which is preferably triangular and inscribed in a circle with a diameter of between 1.2 mm and 1.4 mm.

The teeth 15 of the first rows of teeth 12 and the teeth 25 of the external rows 40 preferably have a height of between 1.3 and 10 mm.

Preferably, the teeth 15 of the outermost first rows of teeth 12*a* and 12*c* and the teeth 25 of the external rows 40 each have a ridge 30 toward the outside of the corresponding application face 10 or 20.

The teeth 25 of the internal rows 50 are preferably conical.

The first rows of teeth 12 can, as illustrated in FIG. 5, be at different distances from one another. The internal row of teeth 12*b* is notably at different distances from the external first rows of teeth 12*a* and 12*c*. It is oriented in the same direction as one of the two external first rows 12*a* and 12*c*.

The teeth 25 of the first rows of teeth 12 and of the external rows 40 can be spaced apart by a distance q of between 0.2 mm and 5 mm, better still between 0.2 mm and 2 mm.

Preferably, the teeth 15 of the same rank in the adjacent first rows 12 are offset with respect to the others, notably by a distance q/2.

As illustrated in FIG. 7, the teeth 15 of the first rows of teeth 12 preferably all have the same length $L_1$ of between 5 mm and 30 mm, better still between 10 mm and 15 mm.

As illustrated, the applicator can comprise elements 60 for retaining the cosmetic product on the first face 10, said elements 60 being disposed longitudinally between the teeth 15 of the outermost first rows 12*a* and 12*c*. The applicator can comprise elements 65 for retaining the cosmetic product on the first face 10, said elements 65 being disposed laterally between the first and last teeth 15 of the outermost first rows 12*a* and 12*c*. The retaining elements 60 and 65 are preferably in the form of walls that are concave toward the outside, are disposed in the spaces 62 between the teeth 15 and connect two adjacent teeth 15 together. The retaining elements 60 and 65 define a space of closed contour on the first application face 10, in which the cosmetic product can be accommodated.

As illustrated in FIG. 7, the maximum height h of the retaining elements 60 and 65 can be less than or equal to 0.5 times the length $L_1$ of the teeth 15, better still less than or equal to 0.3 times the length $L_1$ of the teeth 15.

Preferably, the second application face 20 and the second rows of teeth 22 are symmetrical with respect to a longitudinal plane M passing through the axis Q and perpendicular to the second face 20. In the variant illustrated, the second application face comprises, from the outside toward the plane M:

two external rows 40,
two identical internal rows 50*a*,
two identical internal rows 50*b*, and
a central internal row 50*c*.

Preferably, the two rows 22 of teeth are also symmetrical with respect to a transverse plane N perpendicular to the plane M.

The internal rows 50 can be spaced apart from the external rows 40 by a distance d of between 0.3 mm and 15 mm, better still between 1 mm and 5 mm, defined between the longitudinal axes of the external rows 40.

The teeth 25 of the internal rows 50 can have diameters that are different or the same in cross section. In the example illustrated in FIG. 6, the teeth 25 of the central internal row 50*c* all have the same diameter.

The teeth 25 of the internal rows 50 are preferably disposed in staggered rows with respect to one another.

The internal rows 50 can be spaced apart by a distance r of between 1 mm and 6 mm, defined between the longitudinal axes of the adjacent internal rows 50.

The teeth 25 of each internal row 50 can be spaced apart by a distance s of between 1 mm and 6 mm.

The first and second teeth 52 and 54 of the central internal row 50*c* and the internal rows 50*b* which are adjacent to the latter can be aligned along an axis perpendicular to the axis of the second application face 20.

As illustrated in FIG. 7, the teeth 25 of the second rows 22 can have different heights, notably the teeth of the external rows 40 are the longest and are all the same height. The first and the last teeth 25 in each row are the longest teeth 25 in said row. The greatest length $L_2$ of the teeth 25 of the second rows may be between 2 mm and 30 mm, better still between 5 mm and 15 mm.

Preferably, the ratio of the lengths $L_2/L_1$ is between 0.5 and 1.5, better still between 0.8 and 1.

The handle 5 of the applicator 2 can extend, as illustrated in the figures, substantially along the axis P of the first application face 10. The handle 5 can comprise an upper part 70 in continuation of the first face 10.

The handle 5 preferably has reinforcements 80 for improving the strength of the applicator and making the hand movements more precise. The thickness e of the reinforcements 80 can be between 0.1 mm and 5 mm.

The reinforcements 80 can extend over the entire upper part 70 of the handle 5 and at least partially over the lower part 75 and be inclined relative to the axis P at an angle $\alpha$ of between 0° and 179°.

The body of the applicator 8 can comprise reliefs 90, illustrated in FIG. 7, that represent a pattern.

Preferably, the handle 5 narrows toward its end 85. This narrowing makes it possible to part the hair.

Figure 8:
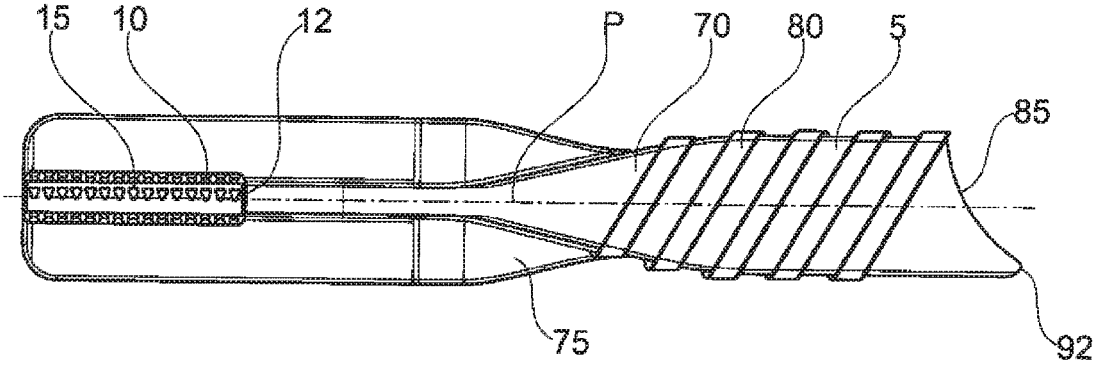
FIG. 8 shows a top view of a variant applicator according to the invention.
Figure 9:
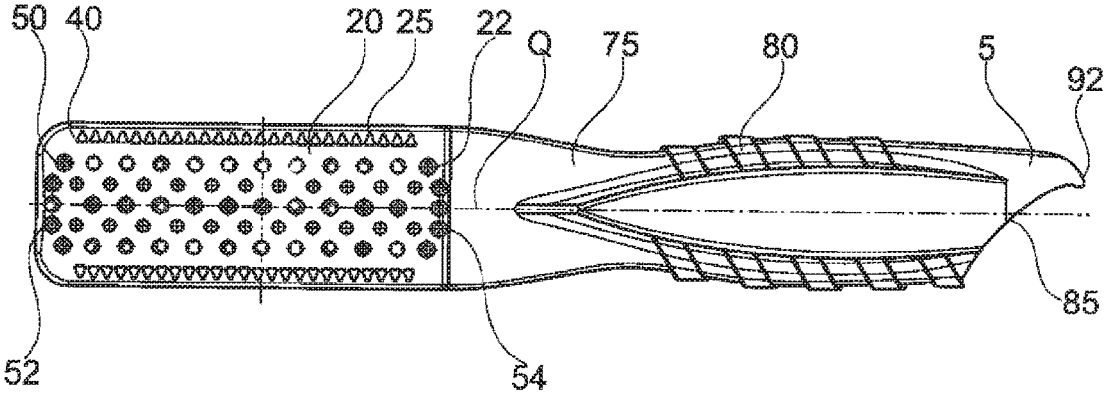
FIG. 9 is a bottom view of the applicator in FIG. 8.

In a variant, as illustrated in FIGS. 8 and 9, the end 85 of the handle 5 forms a point 92 that makes it possible notably to separate the hair.

In variants that are not illustrated, the first and/or the second application face may be curved, notably concave or convex toward the outside. The longitudinal rows of teeth may have a non-rectilinear longitudinal axis, notably one that is slightly curved.

The invention is not limited to the illustrative embodiments which have just been described, the characteristics of which may be combined with one another as parts of variants which are not illustrated.

The first application face can comprise more than three first rows of teeth.

The second application face can comprise an even number of second rows of teeth, the second rows of teeth not comprising central rows of teeth.

The handle can be in continuation of the second application face.

The expression "comprising a" should be understood as being synonymous with "comprising at least one".

The invention claimed is:

1. A hair product applicator comprising:

a first application face that extends in a longitudinal direction, a second application face that is situated on an opposite side from the first application face and that extends in the longitudinal direction, a handle extending along said longitudinal direction in continuation of the first or second application face, the first and second application faces being parallel and separated by a distance between 10 mm and 30 mm, the first application face being less wide than the second application face, the hair product applicator having an overall T shape in cross section at least in a part bearing the first and second application faces, a plurality of first rows of teeth extending from the first application face, each row of the plurality of first rows of teeth extending in the longitudinal direction, and one of the plurality of the first rows of teeth having a length $l_1$, a plurality of second rows of teeth extending from the second application face, each row of the plurality of second rows of teeth extending in the longitudinal direction, and one of the plurality of the second rows of teeth having a length $l_2$, a ratio $l_1/l_2$ being less than or equal to 0.75, wherein the second rows of teeth comprise:

at least two external rows of teeth, at least one internal row of teeth disposed between the two external rows of teeth;

teeth of the external rows of teeth are more flexible than teeth of the at least one internal row of teeth;

each row of the plurality of first rows of teeth is offset in the longitudinal direction from all directly adjacent first rows of teeth; and each row of the plurality of second rows of teeth is offset in the longitudinal direction from all directly adjacent second rows of teeth.

2. The hair product applicator as claimed in claim 1, wherein the ratio $l_1/l_2$ is less than or equal to 0.6.

3. The hair product applicator as claimed in claim 1, wherein the first and the second application faces are flat.

4. The hair product applicator as claimed in claim 1, wherein the plurality of first rows of teeth are parallel.

5. The hair product applicator as claimed in claim 1, wherein the teeth of the plurality of first rows of teeth are not aligned along an axis perpendicular to the longitudinal axis of the first application face.

6. The hair product applicator as claimed in claim 1, wherein the plurality of first rows comprises at least three of the first rows of teeth, the first rows of teeth not being equidistant from one another.

7. The hair product applicator as claimed in claim 1, wherein the teeth of the plurality of first rows of teeth have a pyramid shape with a triangular base.

8. The hair product applicator as claimed in claim 1, wherein the teeth of the plurality of first rows of teeth each have a longitudinal axis perpendicular to the first application face.

9. The hair product applicator as claimed in claim 1, wherein the teeth of the plurality of second rows of teeth each have a longitudinal axis perpendicular to the second application face.

10. The hair product applicator as claimed in claim 1, wherein the teeth of the plurality of first rows are longer than the teeth of the second rows, a ratio $L_2/L_1$ being between 0.5 and 1, $L_1$ being a greatest length of teeth of the first rows of teeth and $L_2$ being a greatest length of teeth of the second rows of teeth.

11. The hair product applicator as claimed in claim 1, wherein the teeth of the external rows of teeth have a pyramid shape.

12. The hair product applicator as claimed in claim 1, the handle being moulded with the applicator.

13. A hair product application system, comprising a hair product applicator as claimed in claim 1 and a container containing the product to be applied, the container comprising a cannula for depositing the product between the teeth of the hair product applicator.

14. The hair product applicator as claimed in claim 1, wherein a longest row of the first rows of teeth has the length $l_1$ and a longest row of the second rows of teeth has the length $l_2$.

* * * * *